US006702393B2

(12) United States Patent
Mercier

(10) Patent No.: US 6,702,393 B2
(45) Date of Patent: Mar. 9, 2004

(54) ROTATABLE CUTTING BIT AND RETAINER SLEEVE THEREFOR

(75) Inventor: Greg D. Mercier, Bristol, VA (US)

(73) Assignee: Sandvik Rock Tools, Inc., Bristol, VA (US)

( * ) Notice: Subject to any disclaimer, the term of this patent is extended or adjusted under 35 U.S.C. 154(b) by 38 days.

(21) Appl. No.: 09/862,460

(22) Filed: May 23, 2001

(65) Prior Publication Data

US 2002/0175555 A1 Nov. 28, 2002

(51) Int. Cl.[7] ..... E21C 35/18
(52) U.S. Cl. ..... 299/107; 299/104
(58) Field of Search ..... 299/102–107, 299/110–111

(56) References Cited

U.S. PATENT DOCUMENTS 4,921,310 A 5/1990 Hedlund et al.

6,378,952 B1 * 4/2002 Moosmann et al. ..... 299/104

FOREIGN PATENT DOCUMENTS

DE 37 12 427 10/1988

* cited by examiner

*Primary Examiner*—Heather Shackelford
*Assistant Examiner*—Sunil Singh
(74) *Attorney, Agent, or Firm*—Burns, Doane, Swecker & Mathis, LLP

(57) ABSTRACT

A cutting assembly includes a holder and a cutting tool body mounted in a bore of the holder, and a retainer sleeve for retaining the tool body axially within the bore while permitting the tool body to rotate freely about a longitudinal axis thereof. The retainer sleeve includes inwardly bent tongues which engage a groove formed in a shank of the tool body. The retainer sleeve is configured to facilitate the escape of fines from the groove during a cutting operation.

4 Claims, 3 Drawing Sheets

ROTATABLE CUTTING BIT AND RETAINER SLEEVE THEREFOR

BACKGROUND OF THE INVENTION

The present invention relates primarily to the retention of mining, trenching and construction tools or bits which are comprised of a hardened steel body with a hard tip and which are retained by a hardened steel retainer sleeve. These tools are mounted to drums, chains and wheels in various orientations and quantity. The bit is then engaged in soft rock formations ranging from asphalt to sandstone. The hard tip fixed to the end of the tool directly engages the material being mined or cut.

Typically the retainer sleeve retains the tool axially while allowing free rotation of the tool during service, as disclosed for example in Hedlund et al., U.S. Pat. No. 4,921,310.

For example, as shown in accompanying FIG. 1, a retainer sleeve 10 is disclosed for retaining a rotary tool 14 in a bore 16 of a holder 18. The sleeve includes tongues 20 that are deformed radially inwardly from a cylindrical portion 22 of the sleeve to engage in an annular groove 24 of the tool. The cylindrical portion 22 continues rearwardly past the tongues 20 and is situated between the outer periphery of a rear flange 26 of the tool and a wall 28 of the bore in order to prevent the flange from contacting the bore wall. The inner diameter of the retainer sleeve is larger than the outer diameter of the tool, to ensure that the tool can freely rotate relative to the stationary retainer sleeve.

It has been discovered that during cutting operations, especially the cutting of gummy materials, such as hot asphalt, fines such as dirt and cuttings can become trapped and packed within the annular groove 24, thereby filling the gap and opposing free rotation of the tool. As a result, a wear flat will develop on the hard tip of the tool progressing down onto the steel body. After developing a wear flat, the tool rotation generally stops, whereby the remaining useful tool life is lost.

Another prior art arrangement described in the Hedlund et al. patent is depicted in accompanying FIG. 2. In that arrangement, the entire rear edge portion of a cylindrical retainer sleeve 32 is bent inwardly to form a flange 30 which is inclined in an axially rearward, radially inward direction and is received in an annular groove 34 of a tool 36. It will be appreciated that an inward bending of the entire rear portion of the sleeve causes the material of the sleeve to bulge radially outwardly at the annular junction between the cylindrical portion 38 of the sleeve and the bent portion 30. That protrusion becomes squeezed between the bore wall and the tool when the tool/sleeve assembly is forced into the bore, thereby applying considerable friction against the tool tending to resist free rotation thereof. Also, since the flange extends continuously in the circumferential direction there is less ability for fines trapped between the flange 30 and a front surface of the groove 34 to escape rearwardly.

One additional prior art arrangement is disclosed in German Patent Document 3712 427 and depicted in the accompanying FIG. 3. In that arrangement, a rear portion of a retainer sleeve 42 is deformed to form tongues 40 that are bent radially inwardly into an annular groove 44 of a tool 46. The deformation step for producing each tongue is performed after a short sleeve-weakening slit has been formed in a cylindrical portion of the sleeve, the slit extending in the circumferential direction. The slits associated with respective tongues are spaced apart from one another in the circumferential direction. Each tongue thus forms a shoulder

48 extending perpendicular to the center axis of the sleeve. That shoulder extends parallel to an opposing front surface 50 of the annular groove 44 to form a gap therebetween from which fines have difficulty exiting, and can result in the above-mentioned opposition to tool rotation.

It is, therefore, an object of the present invention to provide a tool/sleeve assembly which facilitates free rotation of a tool and minimizes a tendency for fines to become packed in a manner preventing such free rotation.

SUMMARY OF THE INVENTION

The present invention relates to a cutting assembly which comprises a holder, a cutting tool body, and a retainer sleeve. The holder includes a bore having a cylindrical bore wall of a first diameter. The cutting tool body defines a longitudinal center axis and includes a front head, a shank, a rear flange, and an annular groove. The front head has a cutting tip, and the shank extends rearwardly from the front head and into the bore. The shank includes an outer cylindrical surface of a second diameter smaller than the first diameter. The rear flange is disposed at a rear end of the shank and is situated within the bore. The rear flange includes an outer cylindrical surface of a third diameter no greater than the second diameter. An annular radial gap is formed between the bore wall and the outer cylindrical surface of the rear flange. The annular groove is formed in the outer cylindrical surface of the shank immediately in front of the rear flange. The groove includes a forwardly facing stop surface. The retainer sleeve retains the tool body axially within the bore while permitting the tool body to rotate freely about the axis. The retainer sleeve includes a cylindrical portion which is slit longitudinally in half and situated radially between the outer surface of the shank and the bore wall. The cylindrical portion is elastically compressed radially by engagement with the bore wall to tightly engage the bore wall. An inner surface of the radially inwardly compressed cylindrical portion has a fourth diameter greater than the second diameter. The retainer sleeve includes circumferentially spaced tongues bent inwardly from the cylindrical portion and extending into the groove to axially retain the tool body in the bore, while permitting the tool body to rotate freely about the axis. Each tongue is inclined in a direction axially rearwardly and radially inwardly from the cylindrical portion, to form an oblique angle with the axis. A longitudinal length of the retainer sleeve is dimensioned such that when the tool is rearwardly pressured during a cutting operation, the tongues are essentially out of continuous contact with the surfaces of the groove, and a rear edge of the cylindrical portion and rear edges of the tongues are spaced forwardly from the forwardly facing stop surface.

The invention also pertains to a cutter tool assembly comprising the body and the retainer sleeve.

BRIEF DESCRIPTION OF THE DRAWING

The objects and advantages of the invention will become apparent from the following detailed description of a preferred embodiment thereof in connection with the accompanying drawings in which like numerals designate like elements and in which.

DETAILED DESCRIPTION OF A PREFERRED EMBODIMENT OF THE INVENTION

Figure 1:
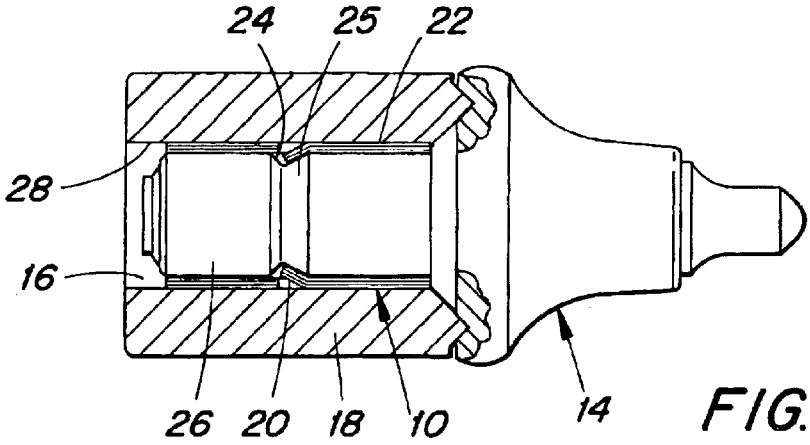
FIG. 1 (PRIOR ART)
FIG. 1 is a longitudinal sectional view of a first conventional cutting assembly.
Figure 2:
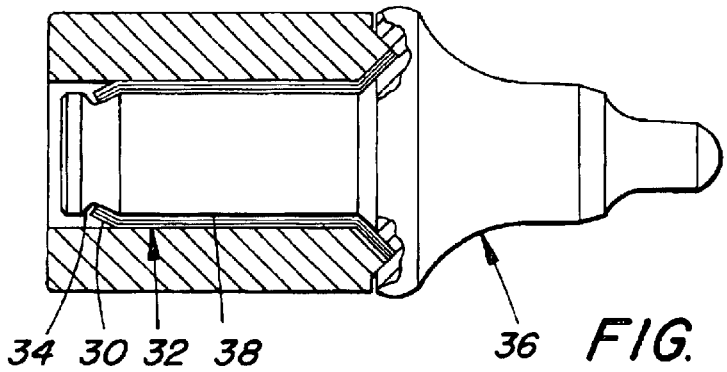
FIG. 2 (PRIOR ART)
FIG. 2 is a longitudinal sectional view of a second conventional cutting assembly.
Figure 3:
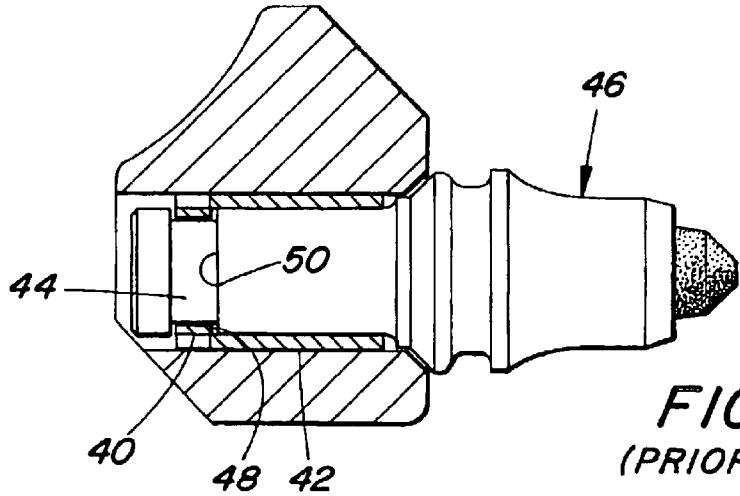
FIG. 3 (PRIOR ART)
FIG. 3 is a longitudinal sectional view of a third conventional cutting assembly.
Figure 4:
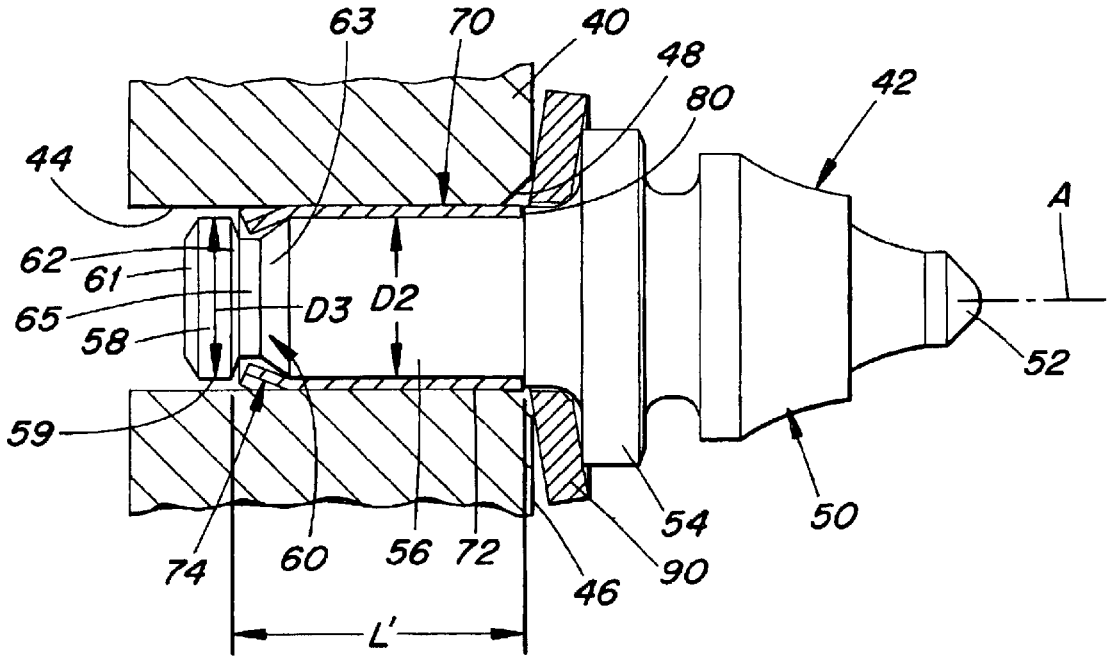
FIG. 4 is a longitudinal sectional view of a cutting assembly according to the present invention.

Depicted in FIG. 4 is a tool holder 40 adapted to be mounted, e.g. bolted or welded, to a vehicle (not shown), and a cutting tool or bit 42 mounted in the holder. There would normally be a plurality of holders 40 and bits 42 mounted on a carrier, such as a rotary drum disposed on the vehicle.

The holder can be formed of steel and includes a cylindrical bore 44 extending through a front face 46 of the holder. The bore 44 has a front bevel 48 at the front face 46 (the bevel preferably being about 40–50 degrees).

The tool 42 includes a body formed for example of hardened steel, the body including a front head 50. A hard cutting tip 52 (e.g., formed of cemented carbide) is mounted in a front end of the head 50. The body defines a longitudinal center axis A.

The head 50 includes a front annular flange 54 of larger diameter than both the cutting tip 52 and the bore 44. The body further includes a shank 56 extending rearwardly from the head 53, the shank 56 having a smaller diameter than the bore 44.

The body further includes a rear cylindrical flange 58 situated at a rear end of the shank 56 and having a diameter no greater than (preferably equal to) that of the shank. Thus, an annular radial gap 59 is formed between an outer cylindrical surface of the rear flange and the cylindrical wall of the bore 44. A rear end 61 of the flange 58 is chamfered to facilitate entry into the bore.

The shank includes an annular groove 60 formed therein immediately in front of the rear flange. That groove 60 includes a bottom surface 65, a forwardly facing surface 62 and an opposing rearwardly facing surface 63. The rearwardly facing surface 63 is inclined in a direction extending axially rearwardly and radially inwardly, thereby promoting the rearward travel of fines that engage the surface 63. The forwardly facing surface 62 defines a rear stop surface.

A retainer sleeve 70 formed preferably of hardened steel is disposed radially between the shank 56 and the cylindrical wall of the bore 44. The retainer sleeve includes a cylindrical portion 72 which has a chamfer 73 at its rear end edge and includes a longitudinal slit 75. In a relaxed state, the cylindrical portion has an outer diameter larger than that of the bore 44. Thus, after being radially compressed and positioned in the bore, the cylindrical portion attempts to rebound outwardly and makes tight contact with the bore wall, while the inner diameter of the compressed cylindrical portion 72 remains greater than the diameter of the shank 56 to minimize any obstruction to free rotation of the tool.

Figure 5:
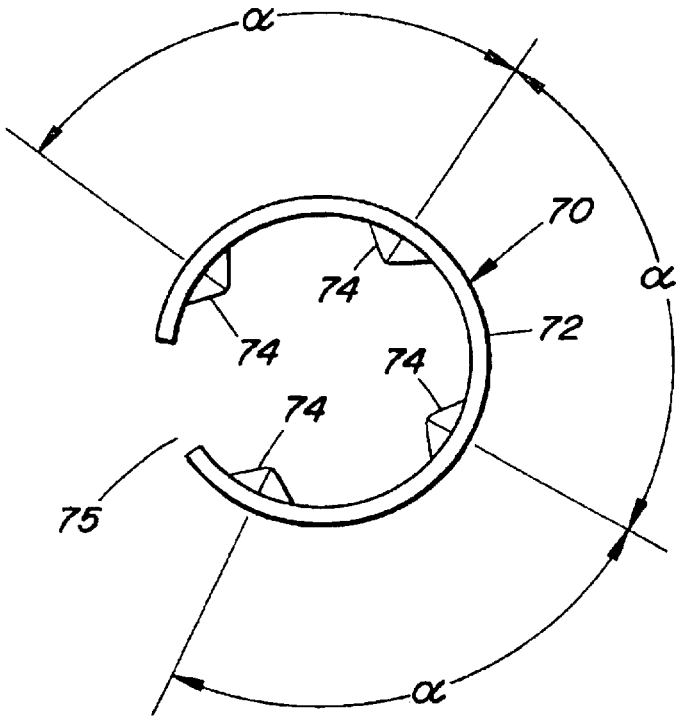
FIG. 5 is a front end view (i.e., taken from the left in FIG. 6) of a retainer sleeve according to the present invention, in a relaxed state.
Figure 6:
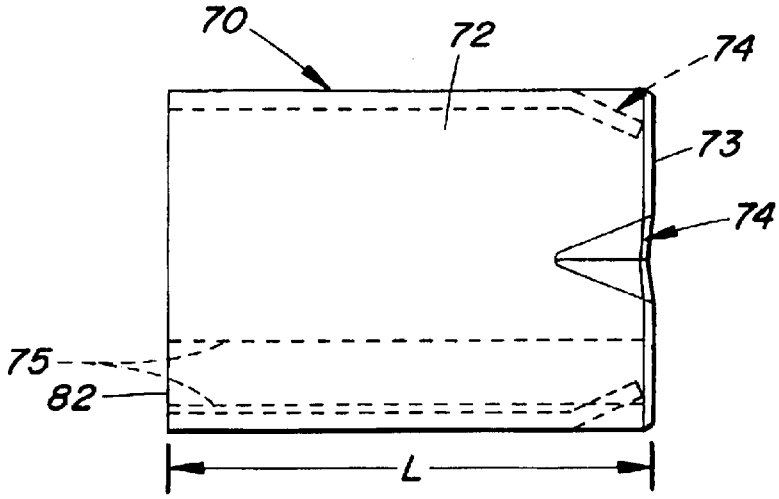
FIG. 6 is a side elevational view of the retainer sleeve of FIG. 5.
Figure 7:
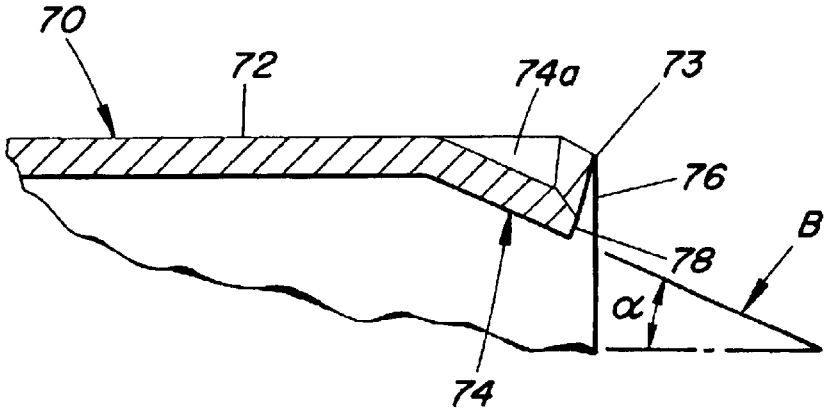
FIG. 7 is an enlarged fragmentary longitudinal sectional view taken through a tongue portion of the retainer sleeve.
Figure 9:
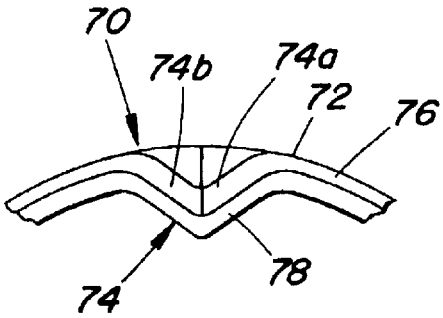
FIG. 9 is a rear end view of the tongue portion shown in FIG. 7.
Figure 8:
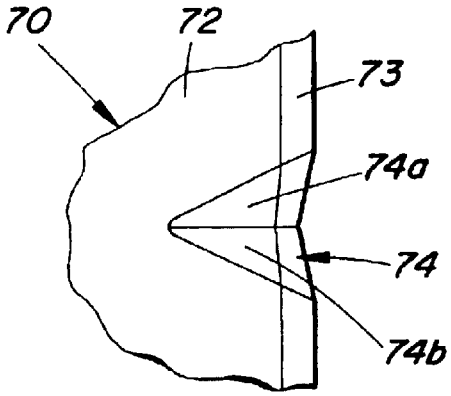
FIG. 8 is a side elevational view of the tongue portion shown in FIG. 7.

The retainer sleeve 70 includes circumferentially spaced tongues 74 bent in a direction extending axially rearwardly and radially inwardly from the cylindrical portion along the rear end edge thereof and extending into the groove 60. Each tongue thus forms an oblique angle $\alpha$ with the axis A. Thus, in response to forward axial movement of the tool 42 relative to the bore, the tongues are abuttable with the rear stop surface 62 of the groove 60 to axially retain the tool in the bore. The direction of bending B of each tongue 74 includes two faces 74*a*, 74*b* converging inwardly from the outer cylindrical surface of the portion 73 of the sleeve, wherein each tongue is V-shaped as viewed along the axis A (see FIGS. 5 and 9). The two faces 74*a*, 74*b* intersect along a line 100 which is inclined in a direction axially rearwardly and radially inwardly from the cylindrical portion to form the oblique angle $\alpha$ with the axis A as viewed in a direction perpendicular to the axis (i.e. as viewed in FIG. 7). During a cutting operation, when the tool 42 is pressed rearwardly, the tongues 74 are, for the most part, spaced from all surfaces 62, 63 and 65 of the groove 60, to enable the tool to freely rotate about its center axis. Due to being inclined axially rearwardly and radially inwardly, the tongues are less obstructive to the rearward travel of fines attempting to escape from between the tongue and the rearwardly facing surface 63 of the groove, as compared to tongues that are oriented perpendicularly to the axis A.

There are preferably four tongues 74, that are spaced circumferentially apart by an angle $\infty$ of preferably 86 degrees, except for the two tongues that are separated by the longitudinal slit 75; the two latter tongues would be separated by an angle of preferably 102 degrees. It will be appreciated that more or fewer tongues could be provided, and at a different angular spacing.

A longitudinal length L of the retainer sleeve 70 is dimensioned such that a rear edge 76 of the cylindrical portion and rear edges 78 of the tongues are spaced forwardly from the rear stop surface 62 when the tool is pushed rearwardly during a cutting operation. In particular, the body of the tool forms a rearwardly facing shoulder 80 (see FIG. 4) at a front end of the shank, the shoulder 80 opposing a front edge 82 of the cylindrical portion 72 of the retainer sleeve. A dimension L' between the rear stop surfaces 62 and the shoulder 80 is longer than the longitudinal length L of the retainer sleeve.

Since the diameter of the rear flange 58 is no greater than the diameter of the shank 56, the radial gap 59 permits the rearward passage of fines exiting the groove 60. The exiting of fines from the groove 60 is possible since the rear edges 76, 78 of the cylindrical portion 72 and the tongues 74 are spaced forwardly from the rear flange 58 during a cutting operation.

Installation of the tool 42 is performed in a conventional manner by first inserting the retainer sleeve 70 onto the shank 56, with the tongues 74 disposed in the groove 60. Then, the rear flange 58 of the tool is inserted into the bore 44. That is, the chamfered rear flange 58 is able to easily enter the bore since it is not covered by the retainer sleeve, and thus functions as a guide or locator to properly position the tool. Thereafter, the tool/sleeve unit is hammered into the bore manually by an operator. In so doing, the cylindrical portion 72 of the retainer sleeve becomes radially compressed, whereupon the cylindrical portion is elastically biased outwardly into firm contact with the bore wall while remaining in loose engagement with the tool shank. The tongues 74 remain disposed within the annular groove 60 to prevent the bit form becoming accidentally dislodged axially from the bore.

A conical washer 90, commonly known as a Belleville washer, is disposed between the tool shoulder and the holder face to aid in keeping fines such as dirt and cuttings from reaching the bore during a cutting operation, as described in detail in U.S. Pat. No. 6,113,195.

During a cutting operation, the tool 42 is pressed rearwardly, and the tongues 74 are out of contact with all surfaces of the groove 60. The tool 42 is free to be rotated by forces applied to the cutting tip by the material being cut, whereby the tool is self-sharpening and wears evenly. Fines may find their way into the groove 60 during the cutting operation. However, instead of becoming packed in the groove and thereby impeding free rotation of the tool, the fines are able to pass rearwardly past the bit since: (i) the cylindrical portion 72 and the tongues 74 stop short of the rear stop surface 62, (ii) the rear flange 58 forms an open radial gap with the bore wall, and (iii) the tongues 74 and the rearwardly facing surface 63 of the groove 60 are inclined axially rearwardly and radially inwardly. Thus, the inclined nature of the tongues 74 and the rearwardly facing surface 63 promotes a rearward migration of the fines. Those fines are able to pass radially outwardly from the groove 60 between the stop surface 62 and the rear end of the cylindrical portion 72, and then axially rearwardly through the radial gap formed between the rear flange 58 and the bore wall. It has also been found that the rear flange 58 will not contact the bore wall, due to the presence of the cylindrical portion 72, which restricts the extent to which the bit can become skewed relative to the axis A.

It will be appreciated that the cutting forces are not applied to the tool in a direction that is exactly aligned with the center axis of the tool. Rather, the forces are inclined somewhat relative to the axis. Thus, the forces cause the shank 56 to become slightly skewed within the bore 44. Thus, each tongue may become intermittently contacted by a surface of the groove 60. However, the contact at any given tongue will not be continuous, thereby enabling fines to migrate out of the groove.

It will be appreciated that the retainer sleeve according to the present invention retains the advantages of prior art retainers in that the tool is held in the bore, and is able to freely rotate without the rear flange 58 coming into direct contact with the bore wall. In addition, however, the tendency for fines to become packed in the annular groove of the tool and hamper free rotation of the tool is minimized. Also, since the rear flange 58 is uncovered by the retainer sleeve, the rear flange can freely enter the bore during a tool installation procedure, and thereby act to locate the tool relative to the bore. In addition, less material is needed to manufacture the retainer sleeve, due to its longitudinally shortened nature.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A cutting assembly comprising:

a holder including a bore having a cylindrical bore wall of a first diameter;

a cutting tool body defining a longitudinal center axis and including:

a front head having a cutting tip, a shank extending rearwardly from the front head and into the bore, the shank including an outer cylindrical surface of a second diameter smaller than the first diameter, a rear flange disposed at a rear end of the shank and situated within the bore, the rear flange including an outer cylindrical surface of a third diameter no greater than the second diameter, wherein an annular radial gap is formed between the bore wall and the outer cylindrical surface of the rear flange, and an annular groove formed in the outer cylindrical surface of the shank immediately in front of the rear flange, the groove including a forwardly facing stop surface; and a retainer sleeve for retaining the tool body axially within the bore while permitting the tool body to rotate freely about the axis, the retainer sleeve including a cylindrical portion slit longitudinally and situated radially between the outer surface of the shank and the bore wall, the cylindrical portion being elastically compressed radially by engagement with the bore wall to tightly engage the bore wall, an inner surface of the radially inwardly compressed cylindrical portion having a fourth diameter greater than the second diameter, the retainer sleeve including circumferentially spaced tongues bent inwardly from the cylindrical portion along a rear end edge and extending into the groove to axially retain the tool body in the bore, while permitting the tool body to rotate freely about the axis, each tongue including two faces converging inwardly from the cylindrical portion wherein each tongue is substantially V-shaped as viewed along the axis, the two faces intersecting along a line inclined in a direction axially rearwardly and radially inwardly from the cylindrical portion to form an oblique angle with the axis as viewed in a direction perpendicular to the axis, a longitudinal length of the retainer sleeve being dimensioned such that when the tool body is rearwardly pressured during a cutting operation the tongues are essentially out of continuous contact with the surfaces of the groove, and a rear edge of the cylindrical portion and rear edges of the tongues are spaced forwardly from the forwardly facing stop surface.

2. The cutting assembly according to claim 1 wherein the body forms a rearwardly facing shoulder at a junction between the front head and the shank for opposing a front end of the cylindrical portion of the retainer sleeve, a longitudinal distance between the forwardly facing stop surface and the rearwardly facing shoulder being greater than a longitudinal length of the retainer sleeve.

3. The cutting assembly according to claim 1 wherein the groove includes a rearwardly facing surface inclined in a direction extending axially rearwardly and radially inwardly.

4. The cutting assembly according to claim 1 wherein the third diameter is equal to the second diameter.

* * * * *